US008314385B2

(12) United States Patent
Moeller

(10) Patent No.: US 8,314,385 B2
(45) Date of Patent: Nov. 20, 2012

(54) SYSTEM AND METHOD TO ELIMINATE RADIO FREQUENCY COUPLING BETWEEN COMPONENTS IN MASS SPECTROMETERS

(75) Inventor: Roy Moeller, San Leandro, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 13/089,980

(22) Filed: Apr. 19, 2011

(65) Prior Publication Data

US 2012/0267521 A1 Oct. 25, 2012

(51) Int. Cl.
*H01J 49/42* (2006.01)
*H01J 49/40* (2006.01)
*H01J 49/26* (2006.01)

(52) U.S. Cl. ..... 250/293; 250/290

(58) Field of Classification Search ..... 250/281, 250/282, 288, 290, 292, 293
See application file for complete search history.

(56) References Cited

U.S. PATENT DOCUMENTS

| | | | | |
|---|---|---|---|---|
| 8,168,944 | B2 * | 5/2012 | Guna | 250/282 |
| 2005/0279930 | A1 | 12/2005 | Nikolaev | |
| 2008/0061227 | A1 * | 3/2008 | Kovtoun | 250/292 |
| 2008/0315086 | A1 * | 12/2008 | Kovtoun | 250/290 |
| 2011/0049357 | A1 * | 3/2011 | Giles | 250/283 |
| 2011/0155902 | A1 * | 6/2011 | Guna | 250/282 |
| 2011/0248157 | A1 | 10/2011 | Sugiyama | |
| 2012/0168619 | A1 * | 7/2012 | Guna | 250/282 |

FOREIGN PATENT DOCUMENTS

JP 61082653 A 4/1986

OTHER PUBLICATIONS

Great Britain Search Report dated Aug. 2, 2012.

* cited by examiner

*Primary Examiner* — Bernard E Souw

(74) *Attorney, Agent, or Firm* — Law Offices of Paul E. Kudirka

(57) ABSTRACT

A radio frequency component for use in a mass spectrometer is described. The radio frequency component includes a plurality of electrodes. The plurality of electrodes is configured around a central axis to create an ion channel within the plurality of electrodes. In addition, each of the plurality of electrodes is paired with an opposing electrode across the central axis. And, at least one electrode pair has an electrode extension on each electrode. The electrode extension is configured to overlap at least a portion of a proximate electrode of a second radio frequency component.

20 Claims, 5 Drawing Sheets

SYSTEM AND METHOD TO ELIMINATE RADIO FREQUENCY COUPLING BETWEEN COMPONENTS IN MASS SPECTROMETERS

FIELD

Embodiments of the invention relate to mass spectrometers. In particular, embodiments of the invention relate to a radio frequency component for use in a mass spectrometer.

BACKGROUND

In mass spectrometry, multiple radio frequency ("RF") components may be used. Examples of radio frequency components used in a mass spectrometer include ion guides, mass filters, and ion traps. Such RF components may be implemented using a quadrupole configuration. Some mass spectrometers use radio frequency components in tandem or adjacent to one another. The close proximity of these components results in RF coupling between the components. Such RF coupling can be more pronounced in systems that do not use lenses or other intervening components between RF components. This RF coupling causes unwanted perturbations from an adjacent RF component on the other RF component. As a result of these external perturbations, the system performance of the mass spectrometer is degraded. For example, external perturbations on a mass filter as a result of RF coupling with an adjacent RF component results in the mass selectivity of the mass filter to shift. This results in the mass filter passing undesired ions through the system, which degrading the results. In addition, adjacent RF components used in mass spectrometers are particularly prone to RF coupling because of the use of high power RF signals.

One solution to reduce RF coupling between components includes rotating the RF components along a shared central axis with respect to one another to minimize the RF coupling between the components. But, this solution degrades the performance of a mass spectrometer because rotating the components with respect to each other creates a mismatch between the exit ion pattern of the first RF component and the entrance acceptance field of the second RF component.

Another solution is to use high voltage, physically attached capacitors between the two adjacent RF components. The high voltage, physically attached capacitors aid in the suppression of the RF coupling between the RF components. However, inconsistencies between the high voltage, physically attached capacitors because of manufacturing tolerances limit the effectiveness of this solution. These inconsistencies in the values of capacitors result in the high voltage, physically attached capacitors not properly reducing the RF coupling as desired. Moreover, changes in capacitance as a result of temperature variations and other operating conditions of a mass spectrometer also reduce the effectiveness of high voltage, physically attached capacitors effectiveness at reducing RF coupling between components. Other problems with using high voltage, physically attached capacitors between RF components to reduce RF coupling between the components include how to mount and connect the capacitors in the mass spectrometer without negatively changing ion flow or other characteristics of the system. Moreover, the use of high voltage, physically attached capacitors is disadvantageous in that the cost of the capacitors significantly adds to the cost of the RF components.

SUMMARY

A radio frequency component for use in a mass spectrometer is described. The radio frequency component includes a plurality of electrodes. The plurality of electrodes is configured around a central axis to create an ion channel within the plurality of electrodes. In addition, each of the plurality of electrodes is paired with an opposing electrode across the central axis. And, at least one electrode pair has an electrode extension on each electrode. The electrode extension is configured to overlap at least a portion of a proximate electrode of a second radio frequency component.

Other features and advantages of embodiments of the present invention will be apparent from the accompanying drawings and from the detailed description that follows.

BRIEF DESCRIPTION OF THE DRAWINGS

Embodiments of the present invention are illustrated, by way of example and not limitation, in the figures of the accompanying drawings, in which like references indicate similar elements and in which.

DETAILED DESCRIPTION

Embodiments of a radio frequency ("RF") component for use in a mass spectrometer are described. In particular, a radio frequency component is described that includes an electrode extension designed to overlap a portion of an adjacent RF component. The electrode extension provides a reduction in external perturbations on the adjacent RF component as a result of RF coupling between the two RF components. Examples of RF components used in a mass spectrometer include, but are not limited to, ion guides, mass filters, ion traps and other RF components known in the art.

Reducing RF coupling or cross talk between adjacent RF components increases the performance of the RF components. This in turn, increases the performance and accuracy of the mass spectrometer. For example, the presence of external perturbations from adjacent RF components results in the characteristics of the RF components deviating from the desired characteristics. One particular example includes a mass filter tuned to pass a specific range of ions having a certain mass-to-charge ratio ("m/z"). Because of the small difference in m/z between sample ions, changes in the RF and/or direct current ("DC") voltages on a mass filter result in ions passing through the filter that are not desired. Conversely, sample ions that are desired to pass through the mass filter may be filtered out as a result of changes in the RF and/or DC voltages. As such, an RF component having an electrode extension to overlap with an adjacent RF component to reduce, to minimize, or to completely remove external perturbations from adjacent RF components optimizes the performance of the RF components.

Figure 1:
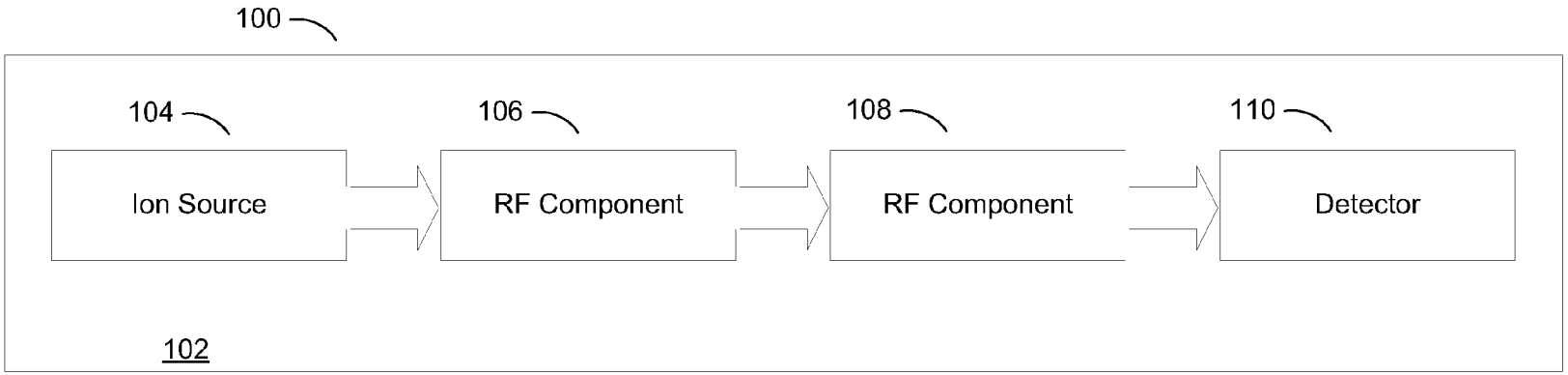
FIG. 1 illustrates a block diagram of components in a mass spectrometer including a radio frequency component according to an embodiment.

FIG. 1 illustrates a block diagram of a mass spectrometer including an embodiment of an RF component. For example, the mass spectrometer may be a tandem mass spectrometer, triple quadrupole mass spectrometer, or other type of mass spectrometer using more than one RF component. For a particular embodiment the mass spectrometer may include four multipole RF components. Mass spectrometer 100 includes a vacuum chamber 102 that includes the other components of the mass spectrometer. The vacuum chamber 102 may be further subdivided to include regions at different pressure levels. The pressure of the vacuum chamber is controlled by one or more vacuum pumps as is known in the art.

Mass spectrometer 100 includes an ion source 104. The ion source 104 may be an electron ionization source or a chemical ionization source. The ion source 104 ionizes the sample molecules desired to be analyzed. The ions then exit the ion source 104 and enter RF component 106. For an embodiment, RF component 106 may be an ion guide, a mass filter, ion trap, or other RF component for use in a mass spectrometer. RF component 106, for an embodiment, may be a multipole device such as a quadrupole, hexapole, octopole or other higher-order pole device. For an embodiment, RF component 106 also includes electrode extensions that overlap a portion of RF component 108, discussed in more detail below. In addition, RF component 108 may include electrode extensions that overlap a portion of RF component 106 in addition to or in lieu of RF component 106 having electrode extensions.

RF component 108 also may be an ion guide, a mass filter, ion trap, or other RF component for use in a mass spectrometer, as discussed above. For an embodiment, a stream of ions or ion beam exits RF component 106 and enters RF component 108. For an RF component configured as an ion guide, an RF voltage source having an amplitude and a frequency is applied to the RF component to generate one or more electromagnetic fields used to guide the ions from the entrance to the exit of the RF component, as is known in the art. Moreover, the electromagnetic field of the ion guide acts on the ions to contain the ions around a center axis. For some RF components configured as an ion guide, the RF components may further be used as a collision cell. For example, the RF component may be configured to receive an inert gas such as argon, helium, nitrogen, or other inert gas to provide collision-induced dissociation of ions passing through the ion guide, as is known in the art.

An RF component configured as a mass filter is used to select a portion of ions entering the RF component that have a certain m/z ratio or range of m/z ratios, as is known in the art. As such, the RF component configured as a mass filter typically has an RF voltage source with a DC component (or a separate DC source) applied to the RF component. The electromagnetic field generated by the RF component provides the force to guide the ions that have the determined m/z ratio through the RF component. While, the DC component acts to force other ions out (away from the central axis) of the RF component.

In the case of an ion trap, RF component may use an RF voltage source with a DC component configured to trap ions having a particular m/z ratio or range of m/z ratios within the RF component, as is know in the art. Examples of an ion trap include, but are not limited to, a Penning trap, Kingdon trap, Orbitrap, a linear ion trap, cylindrical ion trap, or other ion trap known in the art. For an example, the ion trap is used to store ions for subsequent experiments and/or analysis, as is known in the art.

For some embodiments, RF component 106 or RF component 108 may include a transition electrode that extends partially within the adjacent RF component. For example, RF component 106 may include a transition electrode that partially extends within RF component 108. This transition electrode aids the transmission of the ions from RF component 106 to RF component 108. For example, the transition electrode may bridge a gap between RF component 106 and RF component 108 to reduce expansion of an ion beam formed by RF component 106.

Moreover, the transition electrode may have a direct current ("DC") voltage applied to further reduce expansion of an ion beam, thus improving transmission of ions from RF component 106 to RF component 108. For an embodiment, transition electrode may be included in RF component 108 to aid transmission of ions from RF component 106 to RF component 108. For an embodiment, RF component 108 includes an electrode extension that overlaps a portion of RF component 106, discussed in more detail below.

As further illustrated in FIG. 1, ions flow from RF component 108 to detector 110. Detector 110 may be an ion detector as known in the art. In the case of an ion detector, the ions transmitted from RF component 108 are measured. The detector 110, for example, may measure the charge induced or current produced when an ion passes by or hits a surface of the detector. The ion detector may be, but is not limited to, an electron multiplier, a Faraday cup, an ion-to-photon detector, micro-channel plate or other type of ion detector.

Figure 2:
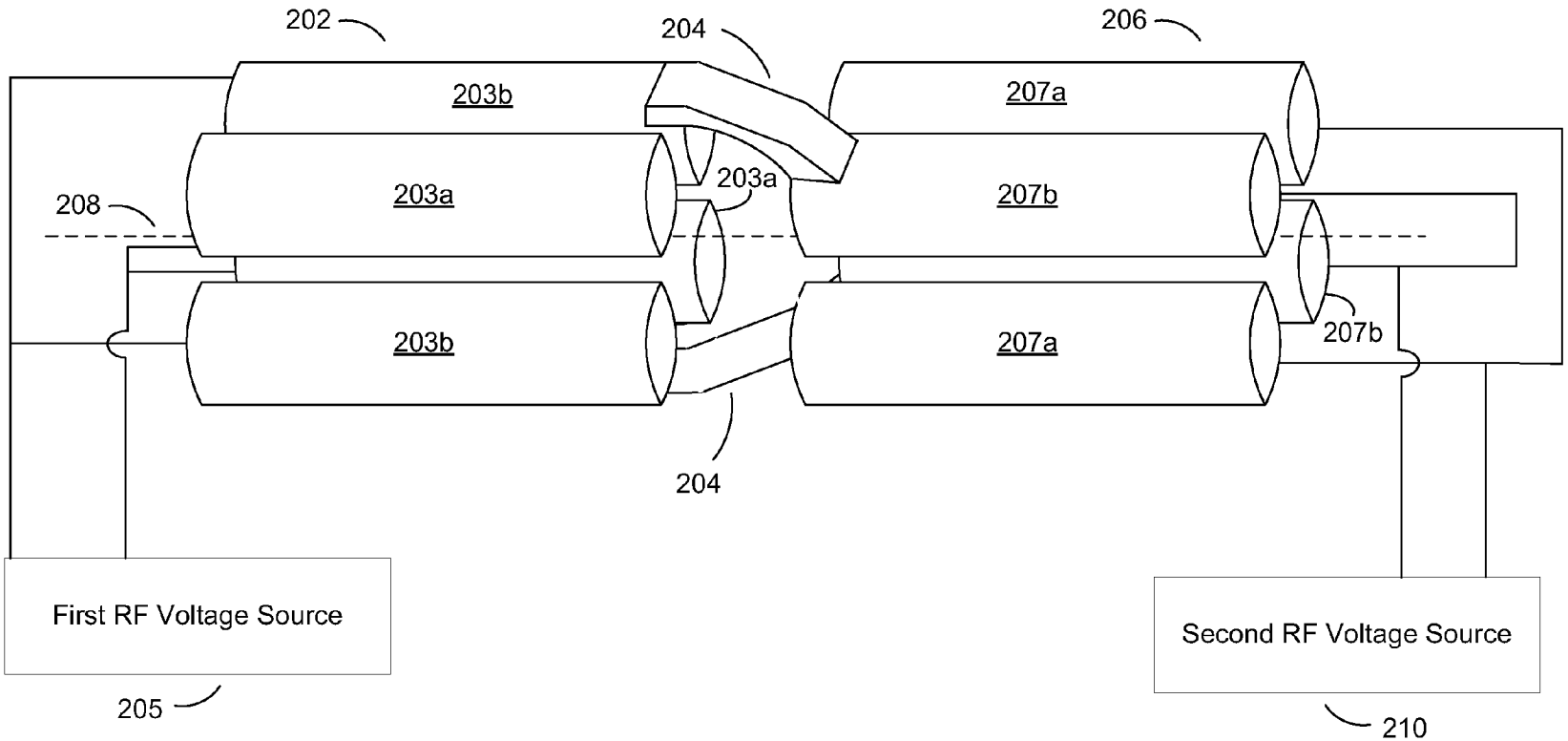
FIG. 2 illustrates an RF component according to an embodiment in tandem with another RF component.

FIG. 2 illustrates an RF component according to an embodiment in tandem with an adjacent RF component. Specifically, FIG. 2 illustrates an embodiment of an RF component configured as a first quadrupole 202, according to an embodiment. First quadrupole RF component 202 includes four electrodes 203 arranged into a first electrode pair 203*a* and a second electrode pair 203*b*.

As illustrated in FIG. 2, the electrode pairs are arranged around a central axis 208 such that the electrodes in each electrode pair are substantially aligned across a central axis 208 such that the electrodes are opposed across central axis 208, according to an embodiment. Moreover, electrodes 203 are configured such that each electrode 203 is substantially equidistant from the central axis 208. And, each electrode 203 is substantially equidistant from each adjacent electrode. In other words, the distance between an electrode in electrode pair 203*a* and an adjacent electrode in electrode pair 203*b* is substantially equal according to the embodiment illustrated in FIG. 2.

For an embodiment, the configuration of electrodes 203 around central axis 208 defines an ion channel within the electrodes 203. When used in a mass spectrometer, ions enter from one end of the first quadrupole 202 substantially centered around central axis 208. According to an embodiment, first RF voltage source 205 may be applied to the electrode pairs 203*a* and 203*b*, as shown in FIG. 2. The first RF voltage source 205 is applied such that the phase of the RF voltage on electrode pair 203*a* is approximately 180 degrees out of phase with electrode pair 203*b*, as is known in the art. Such an RF voltage source produces an electric field on the electrodes 203 to create a force on ions passing through the RF component to help focus the ions around central axis 208 and guide the ions from one end of first quadrupole 202 to the other end of the first quadrupole 202, according to an embodiment.

The RF voltage applied to electrodes 203 may be, but is not limited to, about 10 volts up to about 3000 volts. For a particular embodiment, RF voltage ranges from about 100 to 3000 volts peak to peak. In addition, the frequency of the RF voltage may be, but is not limited to, about 100 kHz up to about 10 MHz. For a particular embodiment, the frequency of the RF voltage ranges from about 1 to about 2 MHz. As is know in the art, the RF voltage source may be swept through a range of voltages to change the operation characteristics of the mass spectrometer based on the type of analysis to be performed. For some embodiments, first RF voltage source 205 may include a direct current ("DC") voltage component.

As illustrated in FIG. 2, an embodiment of a first quadrupole 202 includes electrodes 203 in the shape of circular rods. Other embodiments include electrodes 203 having a hyperbolic shape. Moreover, embodiments include electrodes 203 configured in any shape to produce an electric field as desired. Electrodes 203 may be formed from any conductive material or mixture of materials to form a conductive material. Examples of conductive materials include aluminum alloys, stainless steel, copper, or other materials that conduct electricity.

For an embodiment, electrodes 203*b* are formed such that electrode 203*b* and electrode extension 204 are one piece. In other words, electrode extension 204 and electrode 203*b* may be formed as a single component, according to an embodiment. For other embodiments, electrode extension 204 are formed as a separate piece from electrode 203*b* but configured to be in electrical contact with electrode 203*b*. For example, electrode extension 204 may be affixed to an electrode by being including, but not limited to, soldered, welded, glued, screwed in place, or otherwise such that electrode extension 204 is in electrical contact with electrodes 203*b*.

The embodiment illustrated in FIG. 2 also includes an adjacent RF component configured as a second quadrupole 206 adjacent to the first quadrupole 202. Second quadrupole 206 may be configured as any of the embodiments discussed above with respect to first quadrupole 202. Second quadrupole 206 may be configured to operate as an ion guide, mass filter, or ion trap by setting a second RF voltage source 210 attached to the second quadrupole 206, as is know in the art. As discussed above with respect to first RF voltage source 205, the second RF voltage source 210 may also include a DC voltage component as is known in the art. For mass spectrometers including an embodiment of the RF component, first RF voltage source 205 and second RF voltage source 210 may use the same or different operating characteristics including, but not limited to, RF voltage, frequency, phase, and DC voltage component.

Similar to the first quadrupole 202, the second quadrupole 206 may be configured to operate as an ion guide, mass filter, or ion trap as discussed above. For a certain example, first quadrupole 202 is configured to operate as an ion guide and second quadrupole 206 is configured to operate as a mass filter. For another example, first quadrupole 202 and second quadrupole 206 are each configured to operate as a mass filter. Other examples include one or more of the RF components configured to operate as an ion trap, as is know in the art.

As illustrated in FIG. 2, first quadrupole 202 also includes two electrode extensions 204. According to an embodiment, electrode extension 204 extends such that at least a portion of the electrode extension 204 overlaps a proximate electrode pair 207*b* of second quadrupole 206. For an embodiment, the two electrode extensions 204 couple an RF signal out of phase with the external perturbations present on the second quadrupole 206 corresponding to an RF signal from first quadrupole 202.

For a particular, embodiment electrode extensions 204 induce a current 180 degrees out of phase with the external perturbation with a magnitude equal with that of the external perturbations. As such, the external perturbations are canceled out. For an embodiment including quadrupoles as illustrated in FIG. 2, to induce a current in second quadruple 206 180 degrees out of phase with the external perturbations from first quadrupole 202, electrode extension 204 overlaps with a portion of an electrode disposed 90 degrees about the central axis 208 from electrode 203*b* with electrode extension 204. As such, the external perturbation is reduced on the second quadrupole 206 as a result of the out of phase RF signal from first quadrupole 202 capacitively coupling to second quadrupole 206.

For an embodiment, the cancellation of external perturbations as a result of a portion of the electrode extensions 204 overlapping a portion of second quadrupole 206 is reciprocal. In other words, in addition to reducing external perturbations on second quadrupole 206, the overlapping of the electrode extensions 204 with a portion of second electrode 206 also acts to reduce external perturbations on first quadrupole 202 corresponding to an RF signal on second quadrupole 206. As such, for some embodiments, electrode extensions 204 are included on second quadrupole 206 such that at least a portion of electrode extensions 204 overlap at least a portion of first quadrupole 202.

Figure 3A:
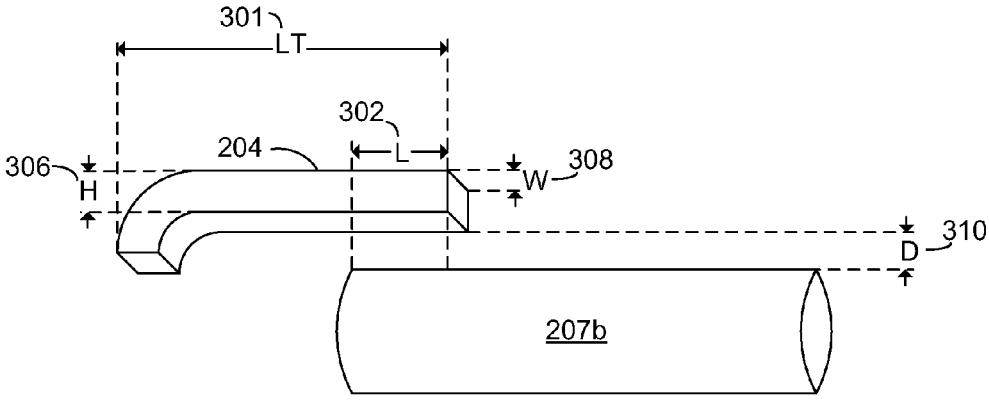
FIG. 3A illustrates an embodiment of an electrode extension having an rectangular cuboid shape.
Figure 3B:
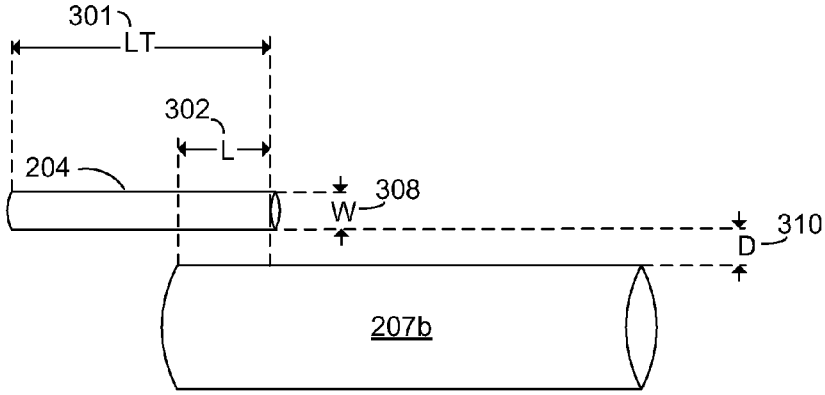
FIG. 3B illustrates an embodiment of an electrode extension having a cylindrical shape.
Figure 3C:
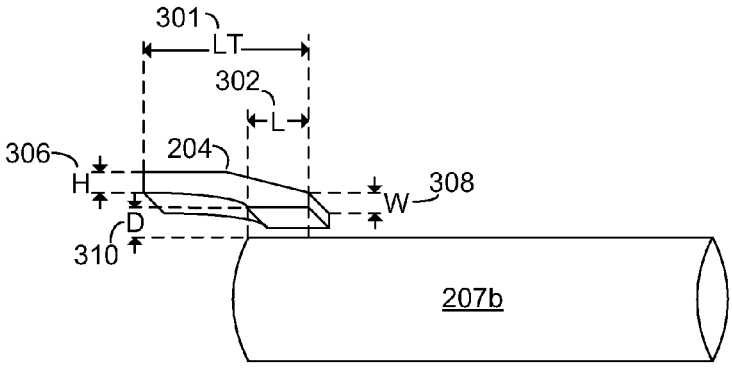
FIG. 3C illustrates an embodiment of an electrode extension having a tapered height.

FIGS. 3A-3C, illustrate some embodiments of an electrode extension 204. As illustrated in FIGS. 3A-3C, the electrode extension 204 may include a wide variety of shapes and sizes including those not illustrated in FIGS. 3A-3C. FIG. 3A illustrates an embodiment that is a rectangular cuboid including a bend toward the end where it would be electrically attached to an electrode of an RF component. FIG. 3B illustrates an embodiment of an electrode extension 204 having an cylindrical shape. In addition, FIG. 3C illustrates another embodiment configured with a body that tapers in height toward the end configured to overlap with proximate electrode 207*b*.

The total length ("LT") 301 of electrode extension 204, for an embodiment, may be fractions of an inch up to several inches. For a particular embodiment, the total length ("LT") 301 is approximately 18 millimeters. The length of overlap ("L") 302, for an embodiment, may be fractions of an inch up to several inches. For a particular embodiment, the overlap is approximately 9.2 millimeters. The height 306 ("H") of an electrode extension 204 may be fractions of an inch up to several inches. For a particular embodiment, the height 306 is approximately 6.3 millimeters. The width 308 ("W") of an electrode extension 204 may be fractions of an inch up to several inches. For a particular embodiment, the width 308 is approximately 6 millimeters. The distance ("D") 310 between electrode extension 204 and proximate electrodes 207*b*, for an embodiment, may be fractions of an inch up to several inches. For a particular embodiment, the distance ("D") 310 between electrode extension 204 and proximate electrode 207*b* is approximately 2.15 millimeters.

For some embodiments, the dimensions of the electrode extension 204 depend on the operating characteristics of RF component. The dimensions of electrode extension 204 may be determined empirically by varying the dimensions to determine the dimensions that result in the desired reduction of external perturbations on the adjacent RF component. Alternatively, the dimensions of electrode extension 204 may be determined using techniques known in the art for radio frequency circuit design.

Figure 4:
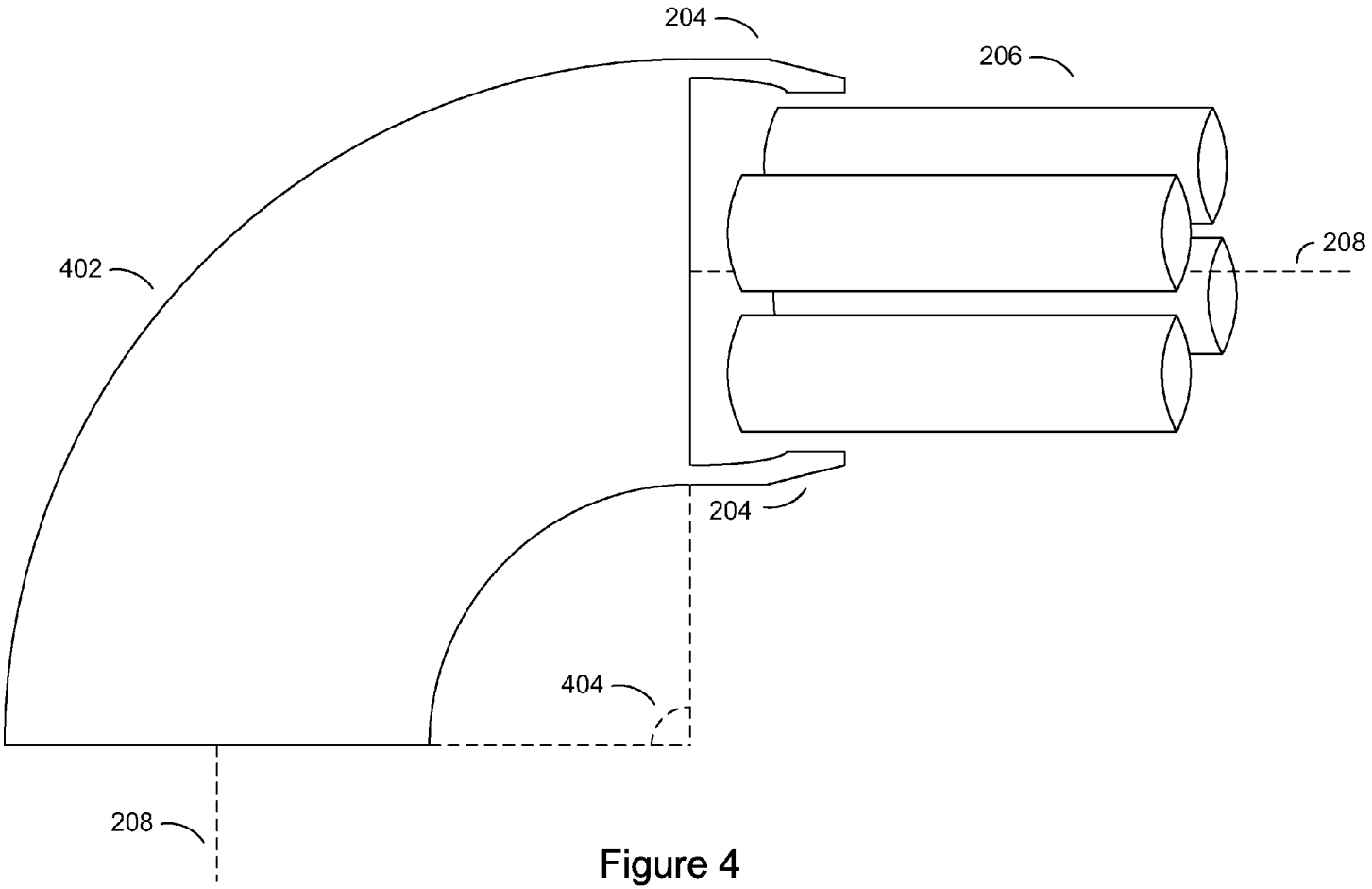
FIG. 4 illustrates a radio frequency component according to an embodiment having a curvature adjacent to a second radio frequency component.

FIG. 4 illustrates a first RF component with a curvature 402 having an electrode extension 204 according to an embodiment. RF component with a curvature 402, according to the embodiment illustrated in FIG. 4, is adjacent to a second RF component 206. Moreover, a portion of each electrode extension 204 overlaps at least a portion of second RF component 206, similar to that discussed above. RF component with a curvature 402, according to an embodiment, has a curvature to guide ions in a different direction than the direction of entry.

Similar to RF components discussed above, RF component with curvature 402 guides ions along a central axis 208, which follows the curvature of RF component with a curvature 402. According to an embodiment, the curvature of RF component with a curvature 402 is such that the path of ions entering RF component changes by approximately 90 degrees with regard to the exit path of the ions. Other embodiments of RF component with a curvature 402 include having a curvature defined by an angle 404 having a value from 1 to 180 degrees. As discussed above, RF component with a curvature 402 may be connected to an RF voltage source with or without a DC component. In addition, the RF components in FIG. 4 may have similar characteristics and functions as discussed above with regard to other RF components.

Figure 5:
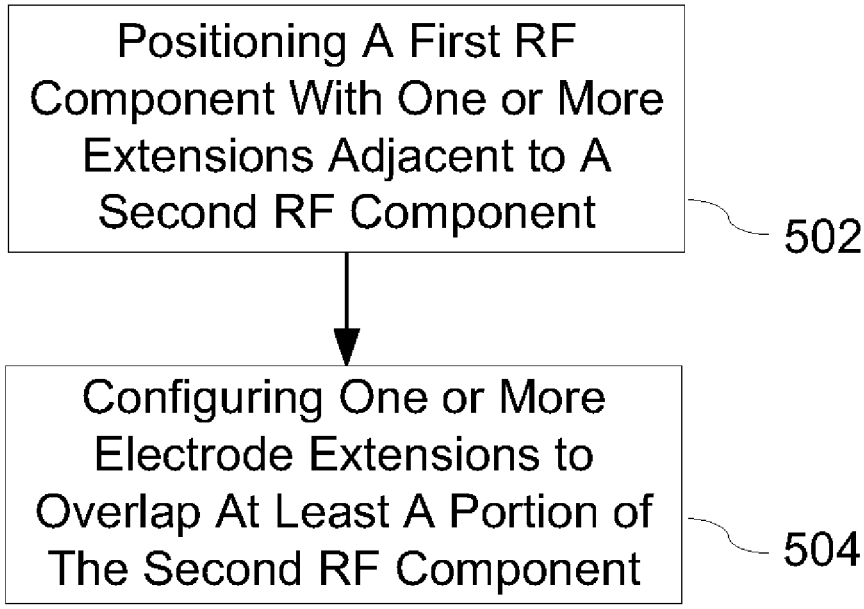
FIG. 5 is a flow diagram for a method of reducing cross talk between adjacent radio frequency components in a mass spectrometer.

FIG. 5 illustrates a flow diagram for a method of reducing external perturbations or cross talk between adjacent RF components in a mass spectrometer, according to an embodiment. At step 502, first RF component having electrode extensions is positioned adjacent to a second RF component. Moving to step 504, the electrode extensions are configured to overlap at least a portion of the second RF component as discussed above. The overlap of the electrode extensions with the second RF component provides a way to reduce or minimize the amount of external perturbations present on the RF components.

In the foregoing specification, specific exemplary embodiments of the invention have been described. It will, however, be evident that various modifications and changes may be made thereto. The specification and drawings are, accordingly, to be regarded in an illustrative rather than restrictive manner. Other embodiments will readily suggest themselves to a person skilled in the art having the benefit of this disclosure.

What is claimed is:

1. A radio frequency component for use in a mass spectrometer, the radio frequency component comprising;

a plurality of electrodes configured around a central axis to create an ion channel within said plurality of electrodes, each electrode of said plurality of electrodes paired with an opposing electrode across said central axis, and at least one electrode pair having an electrode extension on each electrode, said electrode extension configured to overlap at least a portion of a proximate electrode of a second radio frequency component.

2. The radio frequency component of claim 1, wherein said electrode extension on each electrode is formed such that said electrode extension and said corresponding electrode are one piece.

3. The radio frequency component of claim 1, wherein said electrode extension is affixed to said at least one electrode pair.

4. The radio frequency component of claim 1, wherein said plurality of electrodes form a quadrupole.

5. The radio frequency component of claim 4, wherein said quadrupole is a mass filter.

6. The radio frequency component of claim 4, wherein said quadrupole is an ion guide.

7. The radio frequency component of claim 6, wherein said radio frequency component is a collision cell.

8. The radio frequency component of claim 6, wherein said radio frequency component has a curvature.

9. A mass spectrometer comprising:

a first radio frequency component; and a second radio frequency component adjacent to said first radio frequency component, said second radio frequency component having an electrode extension that overlaps with a portion of said first radio frequency component to reduce external perturbations on said first radio frequency component.

10. The mass spectrometer of claim 9, wherein said first radio frequency component is a quadrupole.

11. The mass spectrometer of claim 10, wherein said first radio frequency component is a mass filter.

12. The mass spectrometer of claim 10, wherein said second radio frequency component is a quadrupole.

13. The mass spectrometer of claim 12, wherein said second radio frequency component is an ion guide.

14. The mass spectrometer of claim 13, wherein said ion guide has a curvature.

15. The mass spectrometer of claim 9, wherein said electrode extension is affixed to said second radio frequency component.

16. A method for reducing cross talk between adjacent radio frequency components in a mass spectrometer, said method comprising:

positioning a first radio frequency component having one or more electrode extensions proximate to a second radio frequency component such that coupling between said first radio frequency component and said second radio frequency component creates perturbations on said second frequency component corresponding to signals applied to said first radio frequency component; and configuring said one or more electrode extensions of said first radio frequency component to overlap at least a portion of said second radio frequency component such that said perturbations on said second radio frequency component are reduced.

17. The method of claim 16, wherein said first radio frequency component is a quadrupole.

18. The method of claim 17, wherein said first radio frequency component is a ion guide.

19. The method of claim 17, wherein said first radio frequency component is a mass filter.

20. The method of claim 17, wherein said second radio frequency component is a hexapole.

* * * * *